US006174584B1

(12) United States Patent
Keller et al.

(10) Patent No.: US 6,174,584 B1
(45) Date of Patent: Jan. 16, 2001

(54) WASHABLE COVER FOR MATTRESSES

(75) Inventors: Rainer Keller, Albisheim; Eugeniusz Maderek, Wuppertal, both of (DE)

(73) Assignees: Rudolf Neu GmbH, Worms; Sympatex Technologies GmbH, Wuppertal, both of (DE)

( * ) Notice: Under 35 U.S.C. 154(b), the term of this patent shall be extended for 0 days.

(21) Appl. No.: 09/227,147

(22) Filed: Jan. 8, 1999

(30) Foreign Application Priority Data

Jan. 13, 1998 (DE) ..... 198 00 861

(51) Int. Cl.[7] ..... B32B 5/02; B32B 5/06

(52) U.S. Cl. ..... 428/102; 428/102; 428/103; 428/104; 428/76; 442/261; 442/268; 442/247; 5/499; 5/500; 5/501; 5/502

(58) Field of Search ..... 428/103, 104, 428/76, 102; 442/382, 384, 400, 401, 247, 76, 261, 268; 5/499, 500, 501, 502

(56) References Cited

U.S. PATENT DOCUMENTS

| | | | | |
|---|---|---|---|---|
| 3,888,257 | * | 6/1975 | Cook | 128/296 |
| 4,781,966 | * | 11/1988 | Taylor | 428/152 |
| 4,961,982 | * | 10/1990 | Taylor | 428/41 |
| 5,966,759 | * | 10/1999 | Sanders | 5/499 |

FOREIGN PATENT DOCUMENTS

| | | |
|---|---|---|
| 86 01 894 U1 | 3/1986 | (DE) . |
| 87 00 440 U1 | 4/1987 | (DE) . |
| 3835016 A1 | 4/1990 | (DE) . |
| 402798 A1 | 3/1992 | (DE) . |
| 92 07 837 U1 | 9/1992 | (DE) . |
| 43 39 475 A1 | 5/1995 | (DE) . |
| 94 02 532 U1 | 8/1995 | (DE) . |
| 195 22 333 A1 | 12/1995 | (DE) . |
| 0622488 A1 | 11/1994 | (EP) . |
| 0714950 A2 | 6/1996 | (EP) . |
| 0732073 A1 | 9/1996 | (EP) . |
| 0761715 A1 | 3/1997 | (EP) . |
| 9200790 | 11/1993 | (NL) . |
| WO 90/00969 | 2/1990 | (WO) . |
| WO 93/14929 | 8/1993 | (WO) . |
| WO 94/19178 | 9/1994 | (WO) . |
| WO 96/21379 | 7/1996 | (WO) . |

* cited by examiner

*Primary Examiner*—Terrel Morris
*Assistant Examiner*—Sharmistha Gupta
(74) *Attorney, Agent, or Firm*—Oliff & Berridge, PLC

(57) ABSTRACT

A washable cover for mattresses and like objects, that is made from textile material and includes a water vapor permeable, allergen- and waterproof barrier layer, and an outer material. The cover includes at least one additional textile fabric and a voluminous batting at least 3 mm thick. The batting is arranged between the outer material and additional textile fabric. The outer material, batting, and additional textile fabric are joined together at least pointwise by threads. The barrier layer is laminated onto the additional textile fabric at least pointwise after the latter is joined to the outer material and batting.

18 Claims, No Drawings

WASHABLE COVER FOR MATTRESSES

BACKGROUND OF THE INVENTION

1. Field of Invention

The invention relates to a washable cover for mattresses or similar objects, made from textile material and comprising a water vapor permeable, allergen- and waterproof barrier layer, and an outer material. The invention also relates to a mattress with such a washable cover.

2. Description of Related Art

The suitability of waterproof, water vapor permeable membranes or sheeting for mattress covers is known in the art as exemplified in EP 0 761 715 A1 and DE 43 39 475 A1. In this way, the portion of the perspiration given off by the user and unable to escape into the environment or the covering blanket can be directed into the mattress core, which then gives off the moisture into the environment when the mattress is not in use. It has been noted that, in one night, an average of about 400 ml of perspiration is given off by the mattress user, and about a third of this perspiration must be absorbed by the mattress core in order to provide a comfortable climate for the user. Since a large portion of the perspiration is present in vapor form in the air surrounding the user, this vapor can also enter the mattress core through these membranes or sheeting. The waterproof quality of these membranes or sheeting is of increased importance because on the one hand penetration of perspiration in the form of liquid into the mattress core is effectively prevented, and on the other hand bodily fluids such as blood or urine, which would soil the mattress core and also serve as a breeding ground for the allergens, also cannot penetrate into the mattress core.

In this manner, soiling of the mattress core, which provides a breeding ground for allergens, is avoided effectively. The mattress cover must then be removed regularly from the mattress and washed to remove bodily secretions, which also serve as a breeding ground for allergens, from the cover.

It is also known that such membranes or sheeting can be impermeable to allergens, i.e., impermeable to mites, bacteria, or other microorganisms or solid particles, which can also be in gaseous form and have a adverse effect on the body, as exemplified in EP 714 950 A2, WO 96/21379 and DE 40 27 798. In this case, a portion of the perspiration given off by the user in the form of vapor is directed in turn to the mattress core, while penetration of the allergens present in the perspiration, and other bodily fluids, is avoided.

On the other hand, statements are often made in the art that such membranes or sheeting do not exhibit adequate strength and that these membranes or sheeting must therefore be reinforced by additional textile fabrics. For this reason, such membranes or sheeting are generally in the form of laminates, whereby the membranes or sheeting are often laminated only pointwise to the textile fabrics providing reinforcement, in order to enable permeability for water vapor. Such membranes or sheeting are exemplified in WO 96/21379, WO 94/19178, WO 93/14929, WO 90/00969, EP 0 732 073 A1, EP 0 622 488 A1, DE 195 22 333 A1, DE 40 27 798 A1, DE 38 35 016 A1 and NL 9200790.

While the structures of washable mattress covers described up to now are effective in creating a comfortable climate for the user, they do not offer sufficient comfort when the user is reclining, since the membranes or sheeting known in the art are used only to produce thin covers, and padding between the mattress core and outer material of the cover has not been employed. Such padding, which should be composed of a voluminous, textile material, generally tends to form lumps, so that the padding can be used only if it is quilted (sewn) to the other fabrics in order to prevent displacement of the padding and formation of lumps. Quilting is not possible with waterproof membranes or sheeting, however, because the membranes would thereby lose their waterproofing qualities.

SUMMARY OF THE INVENTION

The object of the present invention is to provide a cover for mattresses, and a mattress with such a cover, which provide not only effective protection against allergens but also a high degree of comfort when the user is reclining.

This object is met by a washable cover for mattresses or similar objects, made from a textile material and comprising a water vapor permeable, allergen- and waterproof barrier layer and an outer material, wherein the cover comprises at least one additional textile fabric and a voluminous batting at least about 3 mm thick. The batting is arranged between the outer material and the additional textile fabric; the outer material, batting, and additional textile fabric are joined at least pointwise by threads; and the barrier layer is laminated at least pointwise onto the additional textile fabric after the latter is joined to the outer material and batting.

DETAILED DESCRIPTION OF PREFERRED EMBODIMENTS

In covers according to embodiments of the invention, the outer material, batting, and additional textile fabric are first joined together by threads and the barrier layer is only subsequently laminated onto the textile fabric. Consequently, the waterproof qualities of the barrier layer are retained effectively, while the textile reinforcement of the barrier layer (membrane or sheeting) is ensured by the additional textile fabric. At the same time, the threads joining the outer material, batting, and additional textile fabric effectively prevent a displacement and consequent lumping of the batting.

Preferably, the batting and additional textile fabric of the washable cover of the invention are sewn together at least pointwise, whereby it has proven especially satisfactory if sewing is performed at regular intervals. Sewing with linearly arranged seams has proven quite satisfactory in this case. The appearance of the washable covers of the invention and the resistance to displacement of the batting can be improved by sewing the batting and additional textile fabric together via seams with a rectangular, square, diamond, or similar pattern.

The comfort of the washable cover when the user is reclining can be increased in particular if the batting has a thickness between about 3 and 40 mm, preferably between about 5 and 25 mm, and a weight per unit area between about 100 and 500 g/m$^2$, preferably between about 200 and 400 g/m$^2$.

In order to provide a favorable climate, it is especially advantageous if the barrier layer has a water vapor permeability of at least 800 g/m$^2$ 24 h. The water vapor permeability in this case is determined according to ASTM E96-66 (Procedure B), whereby the water temperature is selected as 30° C. and the ambient air has a temperature of 30° C. and a relative humidity of 60%.

It is especially favorable if, in the washable cover of the invention, the barrier layer has a water vapor permeability of about 1000 to 8000 g/m$^2$ 24 h, in particular about 1000 to 5000 g/m$^2$ 24 h.

For the shape retention of the washable cover of the invention, it has proven especially advantageous for it to have a top, an underside, and a width of fabric running circumferentially and connecting the top and underside. It is advantageous in this case if the top, underside, and circumferential fabric contain at least the outer material, batting, additional textile fabric, and barrier layer. Of course, the circumferential fabric is comprised of multiple sections in the longitudinal direction, whereby it is especially practical if the circumferential fabric is composed of sections whose length corresponds to the length of the perimeter lines forming the top and underside. The sections of the circumferential fabric can readily be sewn together and to the top and underside, if this is done, for example, in the form of a bead protruding to the outside. In this case, the barrier layers of adjacent sections are pressed tightly together on the inside of this bead via the seam, so that no moisture can penetrate into the mattress core via these seams. Furthermore, sewing to form such a bead increases the shape stability of the cover of the invention as well as its aesthetic appearance.

Especially preferred is a washable cover in which the fabric connecting the top and underside is composed of two circumferential sections that can be joined together, preferably via a zipper. In this case, it is recommended, especially when zippers are used that are insufficiently waterproof, that the two sections overlap on the side facing the mattress core. These overlaps can also be effected by an additional circumferential fabric (zipper cover).

In the washable cover of the invention, it has proven especially satisfactory if the additional textile fabric is a knit with a loop side and a loop underside, and that the loop underside faces the barrier layer. It is also advantageous if the barrier layer exhibits a reversible elongation that is at least as high as the reversible elongation of the additional textile fabric, in order to minimize damage to the barrier layer.

The object of the invention is also met by a mattress having a washable cover according to the invention. It has proven especially beneficial in this case if the washable cover lies flat on the surface of the mattress core.

Suitable for the outer material, also called drill, are woven or terry cloth fabrics made from filaments of natural fibers, synthetic polymers, or blends thereof. For the synthetic polymers, those made of polyester have proven especially advantageous. Wovens with a weight per unit area of about 150 to 400 g/m$^2$ and terry cloth fabrics with a weight per unit area of about 80 to 300 g/m$^2$ have proven especially suitable. The outer material should be finished to be flame retardant as per DIN 54336.

For the batting, voluminous nonwovens are recommended having a good bulk elasticity and a high degree of retractive force even after long periods of use and frequent washing. The fineness of the short and/or continuous fibers forming the batting should preferably be between about 3.3 and 17 dtex; the weight per unit area between about 100 and 500 g/m$^2$, preferably between about 200 and 400 g/m$^2$, for example about 300 g/m$^2$; and the thickness between about 3 and 40, in particular about 5 and 25 mm. In the simplest case, reinforcement of the batting can be effected by needling. However, it is advantageous to provide reinforcement via thermal or chemical binding of the fibers to each other at their intersection points. In the case of chemical binding, it must be ensured that the chemical products employed are safe for the user with respect to allergic and toxic reactions. Acrylic resins have proven highly suitable for reinforcing the batting. Polyester fibers have proven especially advantageous.

For the additional textile fabric, it is beneficial for it to be a knit. Favorable values for weight per unit area lie in the range from about 20 to 150 g/m$^2$. Polyester fibers have proven especially favorable in this case.

Particularly suitable for the barrier layer are membranes as described in WO 94/19178 and EP 0 622 488 A1. Membranes such as those marketed under the name DURETA® (a polyether ester) have proven especially effective. A thickness between about 10 and 30 $\mu$m, for example 15 $\mu$m, is particularly favorable for these membranes. It is of special advantage if the barrier layer is impermeable to particles with dimensions exceeding about 10 nm, preferably exceeding about 1 nm. Such covers are surprisingly impermeable to unpleasant odors that can be produced in the mattress core.

The composite formed by the outer material, batting, and additional textile fabric should be constructed from materials such that the composite has a water vapor permeability between about 1500 and 4000 g/m$^2$ 24 h. Water vapor permeability values in the range of about 2300 to 3000 g/m$^2$ 24 h, in particular from about 2650 to 2700 g/m$^2$ 24 h, have proven highly satisfactory. A thickness of the finished composite in the range of about 6 to 16 mm if the outer material is a woven fabric and about 7 to 20 mm if the outer material is terry cloth has proven to be adequate for most demands regarding comfort when the user is reclining.

A further advantage of the washable cover of the invention is that there is surprisingly no noticeable displacement of the cover on the mattress, such as often occurs if the side facing the mattress core is a textile fabric. This shifting of the mattress cover leads to shifting of the edges of the cover into the area in which the body comes in contact, which is a source of irritation. Such shifting is almost completely nonexistent if, as previously noted, the membranes described in WO 94/19178 and EP 0 622 488 A1 are used for the barrier layer.

The invention will be described in more detail on the basis of the following examples.

EXAMPLE 1

A woven fabric with multifilament polyester threads and a weight per unit area of 216 g/m$^2$ was used as the outer material. The batting was of short polyester fibers and reinforced with acrylic resin as a cross-laid web, and exhibited a weight per unit area of 300 g/m$^2$ and a thickness of 12 mm. The additional textile fabric was a knit made of textured polyester filaments with a weight per unit area of 40 g/m$^2$. The woven fabric, batting, and knit were quilted together, with the seams forming a diamond pattern. The resulting composite had a water vapor permeability of 2650 g/m$^2$ 24 h. On the loop underside of the knit, which was positioned away from the batting, a 15 $\mu$m thick membrane of polyether ester (Dureta®) was laminated thereon using a grid pattern of adhesive points. The membrane prior to lamination had a water vapor permeability of about 3000 g/m$^2$ 24 h.

The resulting material composite exhibited a water vapor permeability of 1300 g/m$^2$ 24 h and was waterproof and impermeable to allergens. After use as a mattress cover, the material composite was largely freed of allergens by simple washing at 60° C. The cover was deemed agreeable by the user with regard to climate and comfort when reclining.

EXAMPLE 2

The outer material was a terry cloth fabric made of textured polyester multifilament threads. It had a weight per unit area of 130 g/m$^2$. The batting, additional textile fabric, and membrane were those as described for Example 1. The outer material, batting, and additional textile fabric were quilted by parallel longitudinal seams, after which the material composite had a water vapor permeability of 2700 g/m$^2$ 24 h. After pointwise lamination of the membrane, the resulting material composite had a water vapor permeability of 1500 g/m$^2$ 24 h. A cover made from this material composite was judged by users to be agreeable with respect to climate and comfort when reclining. After use of the cover on a mattress, the material composite was largely freed of allergens through simple washing at 60° C.

What is claimed is:

1. A washable cover for mattresses, made from textile material and comprising:

a water vapor permeable, allergen- and waterproof barrier layer;

an outer material;

at least one additional textile fabric; and a voluminous batting at least about 3 mm thick, wherein the batting is disposed between the outer material and the additional textile fabric, wherein the outer material, the batting, and the additional textile fabric are joined together at least pointwise by threads, and wherein the barrier layer is laminated onto the additional textile fabric at least pointwise after the additional textile fabric is joined to the outer material and batting.

2. The washable cover according to claim 1, wherein the outer material, batting, and additional textile fabric are sewn together at least pointwise.

3. The washable cover according to claim 2, wherein the outer material, the batting, and the additional textile fabric are sewn together at regular intervals.

4. The washable cover according to claim 2, wherein the outer material, the batting, and the additional textile fabric are sewn together in a linear manner.

5. The washable cover according to claim 4, wherein the outer material, the batting, and the additional textile fabric are joined together via seams that form a rectangular, square or diamond pattern.

6. The washable cover according to claim 1, wherein the batting has a thickness between about 3 and 40 mm and a weight per unit area between about 100 and 500 g/m$^2$.

7. The washable cover according to claim 6, wherein the batting has a thickness between about 5 and 25 mm and a weight per unit area between about 200 and 400 g/m$^2$.

8. The washable cover according to claim 1, wherein the barrier layer has a water vapor permeability of at least about 800 g/m$^2$ 24 h.

9. The washable cover according to claim 8, wherein the barrier layer has a water vapor permeability of about 1000 to 8000 g/m$^2$ 24 h.

10. The washable cover according to claim 1, wherein the washable cover has a water vapor permeability of about 1000 to 5000 g/m$^2$ 24 h.

11. The washable cover according to claim 1, further comprising a top, an underside, and a width of fabric running circumferentially between the top and underside and joining the top and underside.

12. The washable cover according to claim 11, wherein the top, the underside, and the circumferential fabric comprise at least the outer material, the batting, the additional textile fabric, and the barrier layer.

13. The washable cover according to claim 11, wherein the fabric connecting the top and underside comprises two circumferential widths of fabric that can be joined together.

14. The washable cover according to claim 13, wherein the two circumferential widths of fabric are joinable together via a zipper.

15. The washable cover according to claim 1, wherein the additional textile fabric is a knit including a loop side and a loop underside, and the loop underside faces the barrier layer.

16. The washable cover according to claim 1, wherein the barrier layer has a reversible elongation that is at least as high as a reversible elongation of the additional textile fabric.

17. A mattress comprising a washable cover according to claim 1.

18. The mattress according to claim 17, wherein the washable cover lies flat on a surface of a mattress core.

* * * * *